US006918591B2

(12) United States Patent
D'Amico et al.

(10) Patent No.: US 6,918,591 B2
(45) Date of Patent: Jul. 19, 2005

(54) ADJUSTABLE BASKETBALL SYSTEM AND METHOD

(76) Inventors: Karl D'Amico, 6634 Seton House La., Charlotte, NC (US) 28277; Jack Richmond, 1616 Remington Rd., Marion, KS (US) 66861

( * ) Notice: Subject to any disclaimer, the term of this patent is extended or adjusted under 35 U.S.C. 154(b) by 0 days.

(21) Appl. No.: 10/231,786

(22) Filed: Aug. 30, 2002

(65) Prior Publication Data

US 2003/0125140 A1 Jul. 3, 2003

Related U.S. Application Data

(60) Provisional application No. 60/316,419, filed on Aug. 31, 2001.

(51) Int. Cl.[7] ..... A63F 7/20; A63B 63/08

(52) U.S. Cl. ..... 273/317.3; 273/371; 473/481; 473/433

(58) Field of Search ..... 473/481, 433, 473/479, 482, 483, 476, 432, 431, 484; 273/317.3, 371, 397; D21/702, 305

(56) References Cited

U.S. PATENT DOCUMENTS 2,194,779 A * 3/1940 Albach ..... 473/485
3,311,333 A * 3/1967 Galloway ..... 52/295
4,611,812 A * 9/1986 Morrison ..... 473/485
5,074,552 A * 12/1991 Gomez et al. ..... 473/433
5,171,009 A * 12/1992 Filewich et al. ..... 473/433
5,518,233 A * 5/1996 Williams ..... 473/481
6,536,770 B1 * 3/2003 Yang ..... 273/317.3

* cited by examiner

*Primary Examiner*—Stephen Blau
*Assistant Examiner*—M. Chambers
(74) *Attorney, Agent, or Firm*—Kenyon & Kenyon

(57) ABSTRACT

A basketball system that includes a movable platform and a pole rotatably mounted to the movable platform. The pole has either a curved or an angled region, and also has an axis of rotation. The basketball system also includes a backboard mounted to the pole and a rim mounted to the backboard. The rim has a vertical central axis that is coaxial with the axis of rotation of the pole. In addition, the movable platform is horizontally adjustably mounted to a base. A controller may be employed to control the operation of the system, such as by adjusting the distance and rotation of the pole in accordance with a stored program or a user defined preference, by starting and stopping a ball return system in accordance with the player pace of shooting, etc.

16 Claims, 6 Drawing Sheets

ADJUSTABLE BASKETBALL SYSTEM AND METHOD

RELATED APPLICATIONS

This application is based on and claims the benefit of priority to Applicants' U.S. provisional patent application 60/316,419, entitled "Multi-Function Basketball System" and filed on Aug. 31, 2001, the disclosure of which is incorporated by reference herein as fully as if set forth in its entirety.

FIELD OF THE INVENTION

The present invention relates to an adjustable basketball system. More specifically, the present invention relates to an adjustable basketball system that enables a user to simulate, without the user changing his or her position, a basketball shot from various different distances and angles.

BACKGROUND INFORMATION

Basketball is a very popular sport—however, scoring a basket e.g., shooting a basketball through a basketball rim, requires practice to perfect. In order to practice scoring a basket, a player usually needs a basketball court on which to practice. However, a basketball court is quite large and is not easily accommodated in many locations where a player would like to practice shooting baskets.

In those locations where it is impractical or impossible to have a full-sized basketball court, various systems exist that enable a user to simulate scoring a basketball. One such system is the type used in bars or amusement halls. This system employs a rim at a predetermined distance, e.g., typically about ten feet, from a player. The user pays a fee, such as via a coin or bill slot or the like, and tries to score as many baskets as possible in a predetermined amount of time. After each shot is taken, the balls are returned to the player by a sloped or angled floor or netting located under the basket that directs the balls, after being shot, back within the reach of the player. While entertaining, this system is inadequate for practicing shooting a real basketball because the balls and the rim employed in this system are smaller than the regulation-size balls and rims used in a real basketball game. Thus, the entertainment system does not provide a user with an accurate simulation of shooting a real basketball.

In addition, the sloped or angled floors used in such a system to return the balls to the player render this system inadequate for practicing shooting real basketballs. In a real basketball game, the floor of the basketball court is level, and thus a player is accustomed to seeing the rim positioned at the same height relative to the floor regardless of the player's position on the court or the player's distance from the rim. In the conventional basketball system that employs sloped or angled floors to return the basketballs to the player, the floor of the system rises closer to the rim as a player's shot distance increases, thereby impeding the player's shot perception.

SUMMARY OF THE INVENTION

The present invention, according to one embodiment thereof, relates to a basketball system that includes a movable platform and a pole rotatably mounted to the movable platform. The pole has at least one of a curved and an angled region, and also has an axis of rotation. The basketball system also includes a backboard mounted to the pole and a rim mounted to the backboard. The rim has a vertical central axis that is coaxial with the axis of rotation of the pole. In addition, the movable platform is horizontally adjustably mounted to a base.

The system may employ various sensors to control the operation of the system. For instance, the system may include a distance sensor for determining a distance between the pole and a player position. The system may also include a scoring sensor for determining when a ball passes through the rim. In addition, the system may include a rotational sensor for determining a rotation of the pole.

A rotation mechanism is employed for rotating the pole relative to the movable platform. Preferably, a controller is employed to control the operation of the rotation mechanism in accordance with either a program stored in the controller, a user preference provided via a user interface, or a signal from the rotational sensor. In addition, a horizontal adjustment mechanism is employed for horizontally adjusting the movable platform relative to the base. The controller may be configured to control the operation of the horizontal adjustment mechanism in accordance with either a program stored in the controller, a user preference provided via a user interface, or a signal from the distance sensor.

The system may also include a ball return system including at least one conveyor for returning a ball to a player. The ball return system may include a single belt conveyor; a ball rack accessible to a user; and a dual belt ball feed system for lifting a ball from the single belt conveyor to the ball rack. In order to reduce the likelihood of the balls jamming, each belt of the dual belt ball feed system is operated by a single motor so as to rotate at an identical speed. Preferably, the ball return system operates at a pace similar to the player pace of shooting. In order to accomplish this, the system may be configured such that the controller is coupled to a ball sensor located in a ball rack and to the ball return system, the controller being configured to control the operation of the ball return system in accordance with a signal received from the ball sensor.

DETAILED DESCRIPTION

Figure 1:
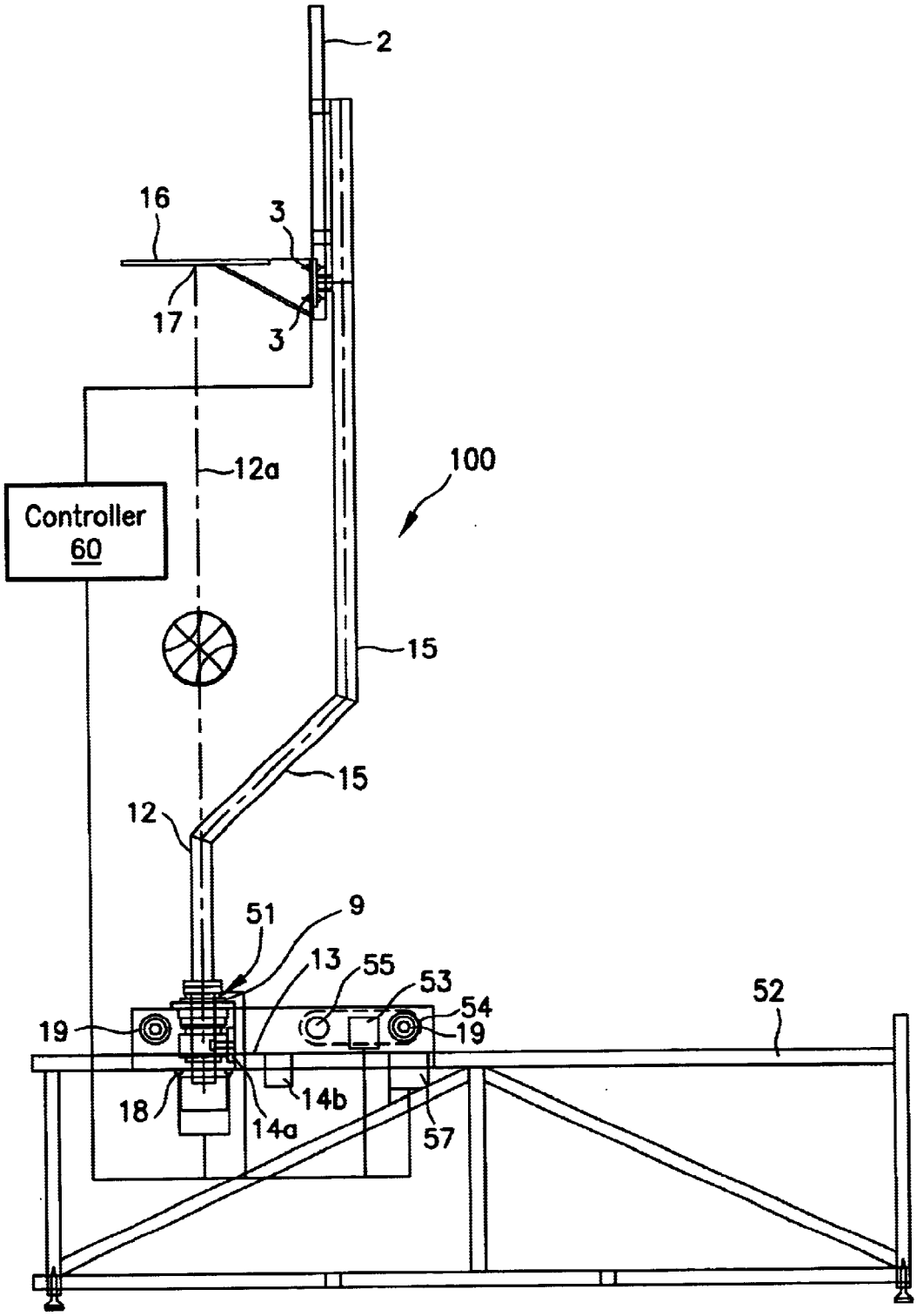
FIG. 1 is a side view that illustrates part of a basketball system, in accordance with one embodiment of the present invention.

FIG. 1 is a diagram, e.g., a side view, that illustrates some of the components of a basketball system 100, in accordance with one embodiment of the present invention. According to the embodiment shown in FIG. 1, the basketball system 100 includes a movable platform 13, onto which is rotatably mounted a pole 12. The pole 12 has an axis of rotation 12*a*. The basketball system 100 may include a rotation mechanism 51 for rotating the pole 12 relative to the movable platform 13. The rotation mechanism 51, according to one embodiment of the present invention, may include a gearbox 14*a* and a motor 14*a*. Though any degree of rotation is possible, in a preferred embodiment of the present invention, the pole 12 is configured to be rotated between 0 and 180 degrees.

The basketball system 100 also includes a backboard 2 mounted to the pole 12. Mounted to the backboard 2 is a rim 16. Preferably, the backboard 2 and the rim 16 are regulation size, e.g., they are the same size as the backboard and rims used in real basketball games. However, the present invention is not intended to be limited in this regard, and other sizes of the backboard and the rim may be employed. In addition, in the preferred embodiment of the present invention, the backboard 2 and the rim 16 are arranged at the same height as the backboard and rim used in real basketball games. However, the present invention is not intended to be limited in this regard, and the backboard and rim may also be arranged at different heights.

The rim 16 has a vertically-disposed central axis 17 that, according to the preferred embodiment of the present invention, is coaxial with the axis of rotation 12*a* of the pole 12. In order to enable the vertically-disposed central axis 17 of the rim 16 to be coaxial with the axis of rotation 12*a* of the pole 12, the pole 12 may be, according to various embodiments of the present invention, curved and/or angled. For instance, in the embodiment shown in FIG. 1, the pole 12 has a vertically-disposed base portion that is attached to the movable platform 13, a vertically-disposed top portion and an angled/curved portion 15 therebetween. However, the present invention is not intended to be limited to this particular configuration, and any configuration of curves and angles of the pole 12 may be employed. By arranging the central axis 17 of the rim 16 to be coaxial with the axis of rotation 12*a* of the pole 12, the pole 12 may be rotated without changing the distance between a player position, e.g., the position at which a user stands when shooting the basketball, and the central axis 17 of the rim 16. Of course, the specific angles or curves in the pole 12 may be dependent on the dimensions of the backboard 2 and the rim 16 -e.g., different size backboards and rims will require a greater or lesser pole angle or curvature in order to orientate the central axis 17 of the rim 16 over the axis of rotation 12*a* of the pole 12.

According to a preferred embodiment of the present invention, the basketball system 100 also includes a base 52 upon which the movable platform 13 is mounted. More specifically, the movable platform 13 is mounted on the base 52 so as to be horizontally adjustable relative to the base 52. The basketball system 100 may include a horizontal adjustment mechanism 53 for horizontally adjusting a position of the movable platform 13 relative to the base 52. The horizontal adjustment mechanism 53, according to one embodiment of the present invention, may include any mechanical-type mechanism, but preferably includes a motor 55 that drives a chain 54, enabling the movable platform 13 to move on wheels 19. The horizontal adjustment mechanism 53 enables the distance between a player position and the movable platform 13 (and thus the distance between a player position and the rim 16) to be increased or decreased as desired. In a preferred embodiment, the horizontal movement of the pole 12 is independent from the rotation of the pole 12.

The basketball system 100 may also include, as shown in FIG. 1, at least one rotation sensor 18. Preferably, the basketball system 100 employs a pair of rotation, e.g., homing, sensors 18 mounted adjacent to the base portion of the pole 12. The rotation sensors 18 are employed to determine and/or control the rotational position of the pole 12, so as to insure that the backboard 2 is rotated accurately. It is noted however, that the use of these rotation sensors 18 is merely one possible method of determining and/or controlling the rotational position of the pole 12, and that other devices or methods may be employed in the present invention for this purpose.

The basketball system 100 may also include, as shown in FIG. 1, at least one scoring sensor 3. Preferably, the basketball system 100 employs a pair of scoring sensors 3 mounted at predetermined positions on the backboard 2 or rim 16. The scoring sensors 3 are configured to determine when a ball passes through or does not pass through the rim 16. It is noted however, that the use of these scoring sensors 3 is merely one possible method of determining when a ball does or does not pass through the rim 16, and that other devices or methods may be employed in the present invention for this purpose.

The basketball system 100 may also include, as shown in FIG. 1, a distance sensor 57. Preferably, the basketball system 100 employs a distance sensor, e.g., a transducer, 57 mounted to the movable platform 13. The distance sensor 57 may be employed to determine and/or control the horizontal distance of the movable platform 13 relative to the base 52, so as to insure that the backboard 2 is horizontally adjusted accurately. It is noted however, that the use of a distance sensor, such as a transducer, 57 is merely one possible method of determining and/or controlling the horizontal position of the movable platform 13, and that other devices or methods may be employed in the present invention for this purpose.

Figure 2:
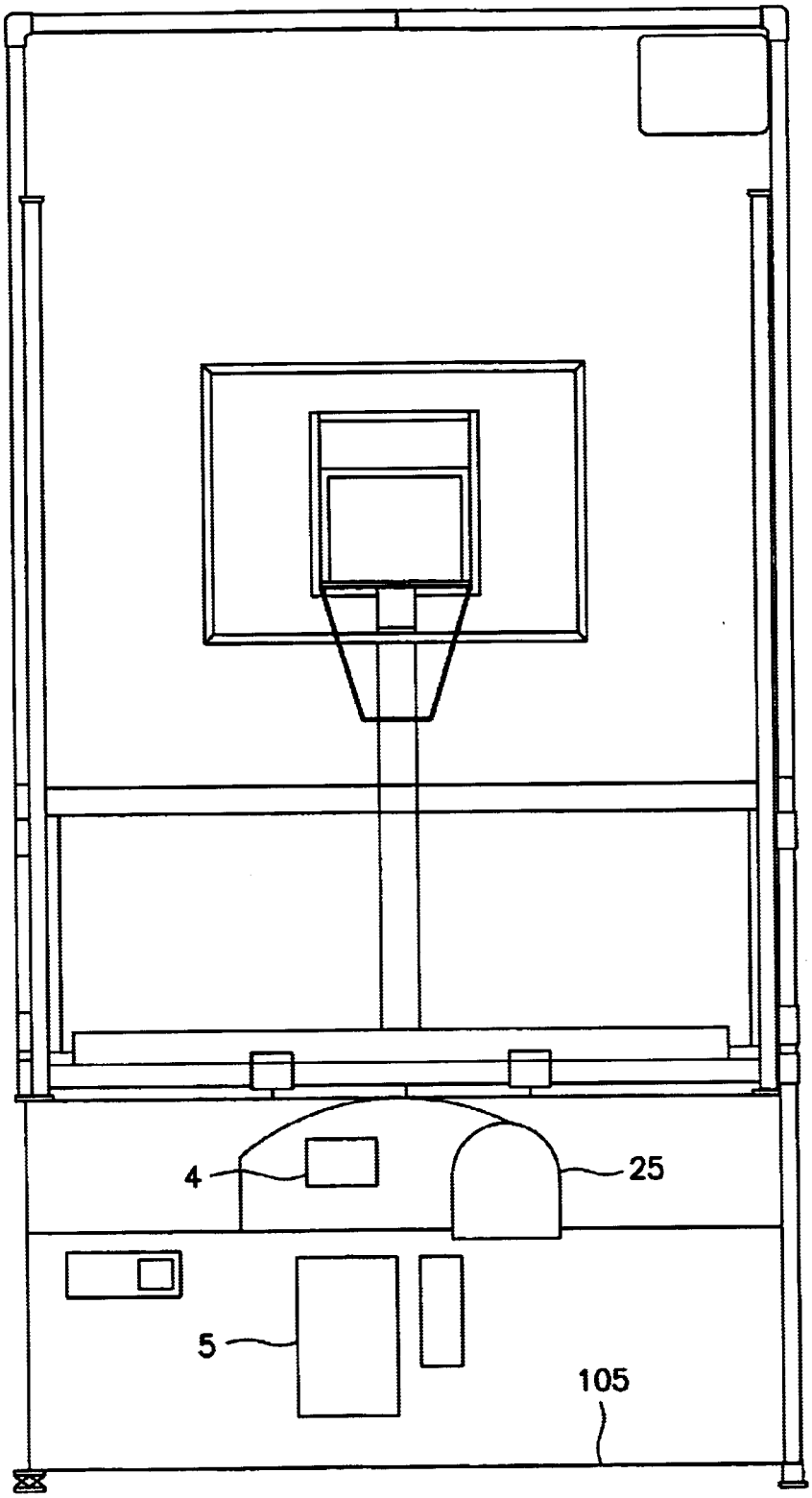
FIG. 2 is a front view that illustrates the basketball system shown in FIG. 1.

The basketball system 100 may also include a controller 60 which is configured to control the operation of the basketball system 100. For instance, the controller 60 may be coupled to the rotation sensors 18 in order to determine a rotational position of the pole 12. In addition, the controller 60 may be coupled to the rotation mechanism 51 in order to control, based upon signals received from the rotational sensors 18, the rotational position of the pole 12. The controller 60 may also be configured, according to various embodiments of the present invention, to control the rotational position of the pole 12 based on a predetermined program stored in the controller 60 or in response to user preferences provided to the controller 60 by a user interface. One such user interface may be touch screen 4 shown in FIG. 2. Briefly, FIG. 2 illustrates the basketball system 100 from a front view, e.g., from the perspective of a player standing at a player position.

Similarly, the controller 60 may also be coupled to the distance sensor 57 in order to determine the horizontal position of the movable platform 13 or the pole 12. In addition, the controller 60 may be coupled to the horizontal adjustment mechanism 53 in order to control, based upon signals received from the distance sensor 57, the horizontal position of the movable platform 13 or the pole 12. The controller 60 may also be configured, according to various embodiments of the present invention, to control the horizontal position of the movable platform 13 or the pole 12 based on a predetermined program stored in the controller 60 or in response to user preferences provided to the controller 60 by a user interface, such as touch screen 4.

Likewise, the controller 60 may also be coupled to the scoring sensors 3 in order to determine whether a ball does or does not pass through the rim 16. In this embodiment of the present invention, the controller 60 may be configured to determine, process and/or store data corresponding to the number of shots that were scored by a player and the number of shots that were missed. The controller 60 may include memory locations that are configured to store, in accordance with instructions provided by software of the controller 60, scoring data for a particular player. The controller 60 may also be configured to determine, process and/or store data corresponding to the number of shots that were scored by a player and the number of shots that were missed in conjunction with the horizontal and/or rotational position of the rim 16. In this manner, the controller 60 may provide valuable feedback to the player indicating the player's shot percentage from different distances and angles, enabling the player to identify those shooting distances or angles which need to be improved.

Thus, according to one embodiment of the present invention, the sequence of movements of the pole 12, e.g., the horizontal and rotational adjustments, is determined by a computer-generated program of the controller 60, which may be selected by a player prior to playing. Therefore, the basketball system 100 eliminates the need for the shooter to physically adjust, relocate or reposition the distance or shot angle of the pole 12, backboard 2 or even himself or herself prior to or during play. A player can stand in a single position and take successive shots, the controller 60 moving either or both of the horizontal distance and the angle of rotation of the pole 12 and the backboard 2. Alternatively, a player can stand in a single position and take successive shots wherein the controller 60 only rotates the pole 12 without moving the pole 12 horizontally—because the central axis 17 of the rim 16 is coaxial with the pole 12, the player can thus practice shooting the ball at the rim from the same distance, but at different angles.

As previously mentioned, FIG. 2 illustrates a front view of the basketball system 100 system. From player position 105, a player has access to a ball rack 25, from which balls are dispensed for the player to use. A user interface 4, such as the touch screen 4, enables the player to enter data, such as data corresponding to a desired program of distances and angles, data corresponding to the player's identity, data corresponding to the player's skill level, etc. Of course, these are just several examples of the type of data that may be entered into the basketball system 100 via the user interface 4 by a player, and the present invention is not intended to be limited to merely these types listed here. In addition, the user interface 4 may include a display device that displays data to a player. For instance, according to one embodiment of the present invention, the user interface 4 includes a display screen that shows a player's score, e.g., the number of shots taken and/or the number of shots scored. It is noted that the touch screen 4 is merely one type of user interface that may be employed in the basketball system 100, and the present invention contemplates the use of any type of user interface for this purpose. Preferably, the user interface 4 and any display screen employed by the basketball system 100 is controlled by the controller 60.

Figure 3:
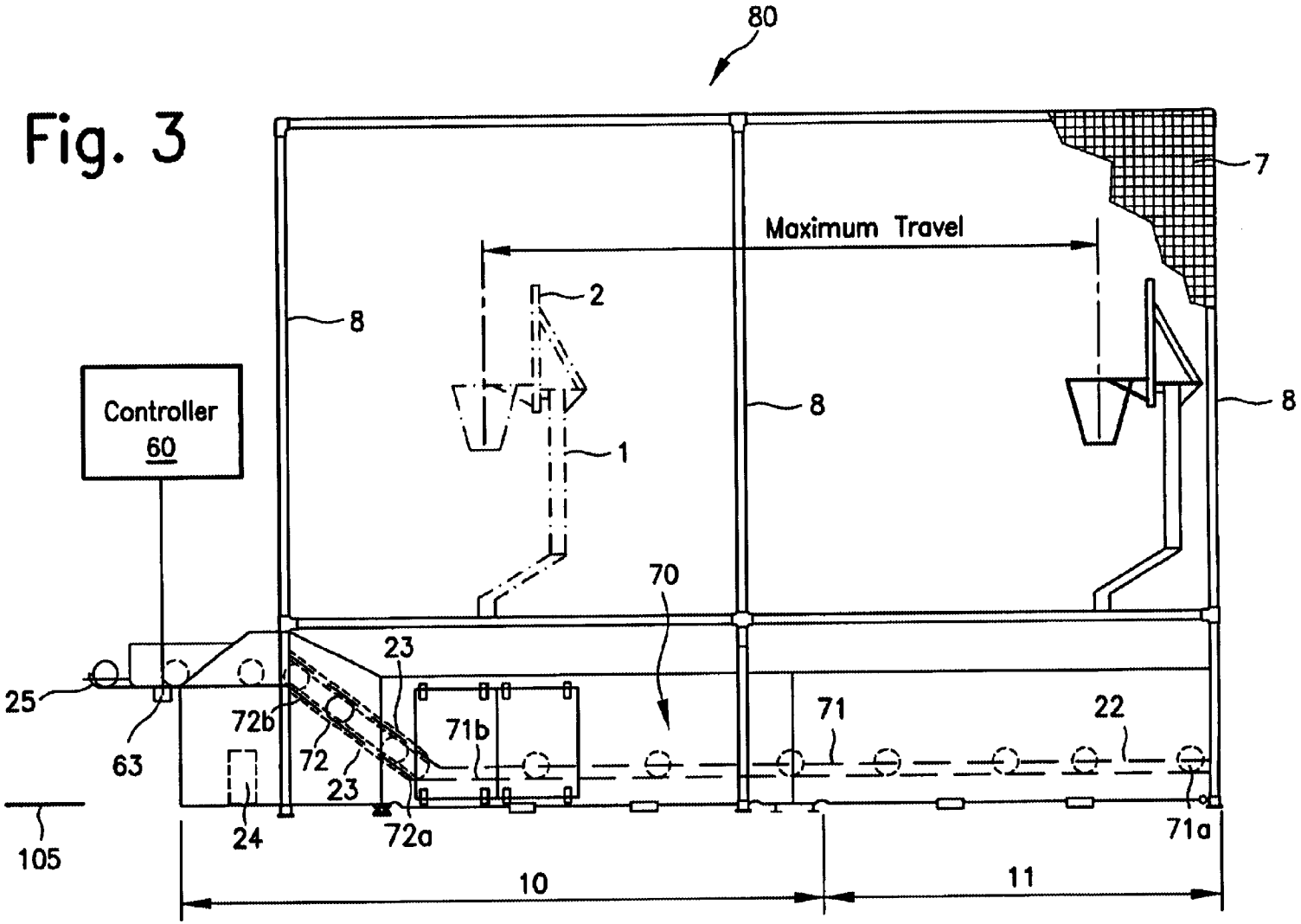
FIG. 3 is a side view that illustrates additional features of the basketball system, in accordance with another embodiment of the present invention.
Figure 4:
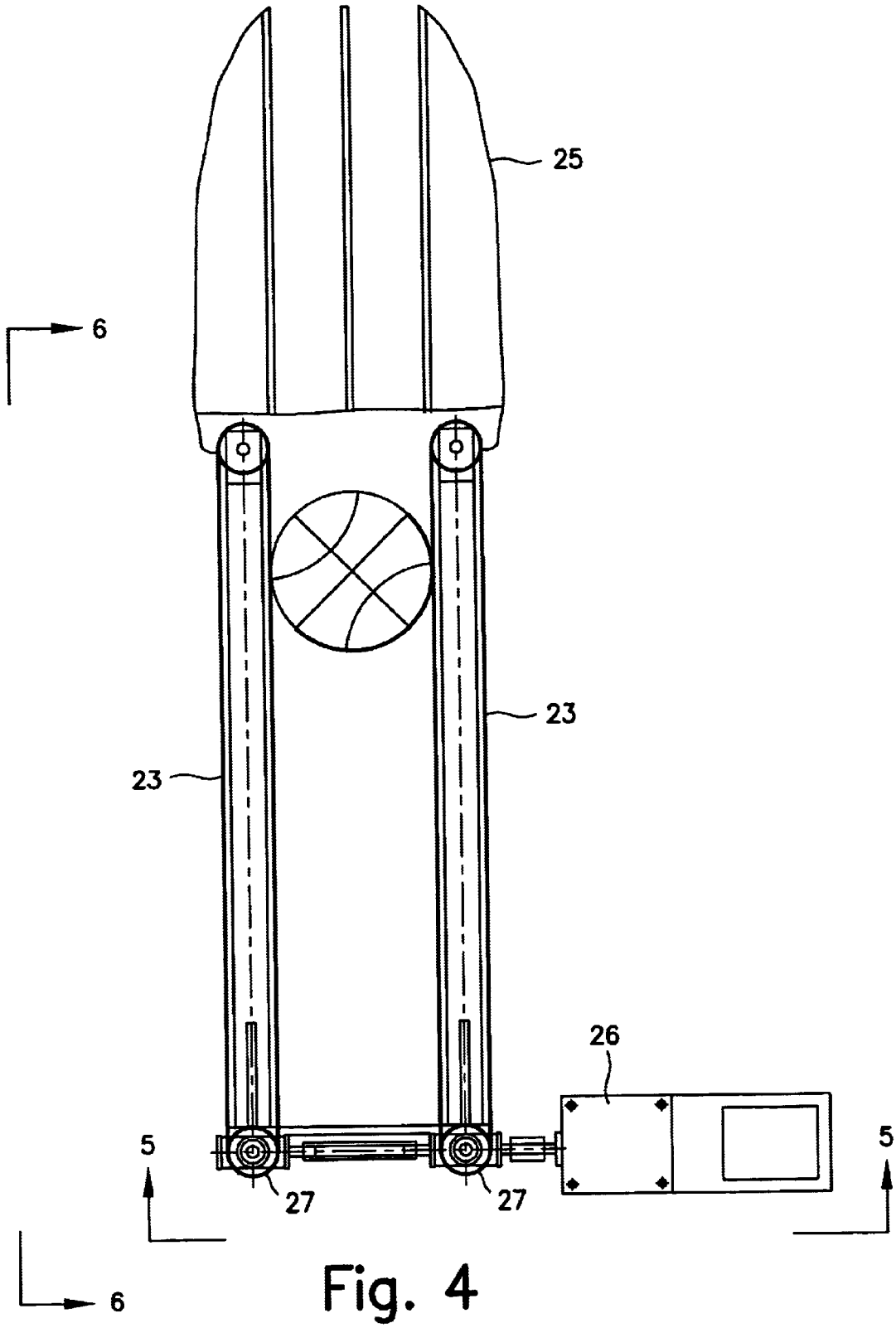
FIG. 4 is a diagram, in plan view, that illustrates the dual belt ball feed system, according to one embodiment of the present invention.
Figure 5:
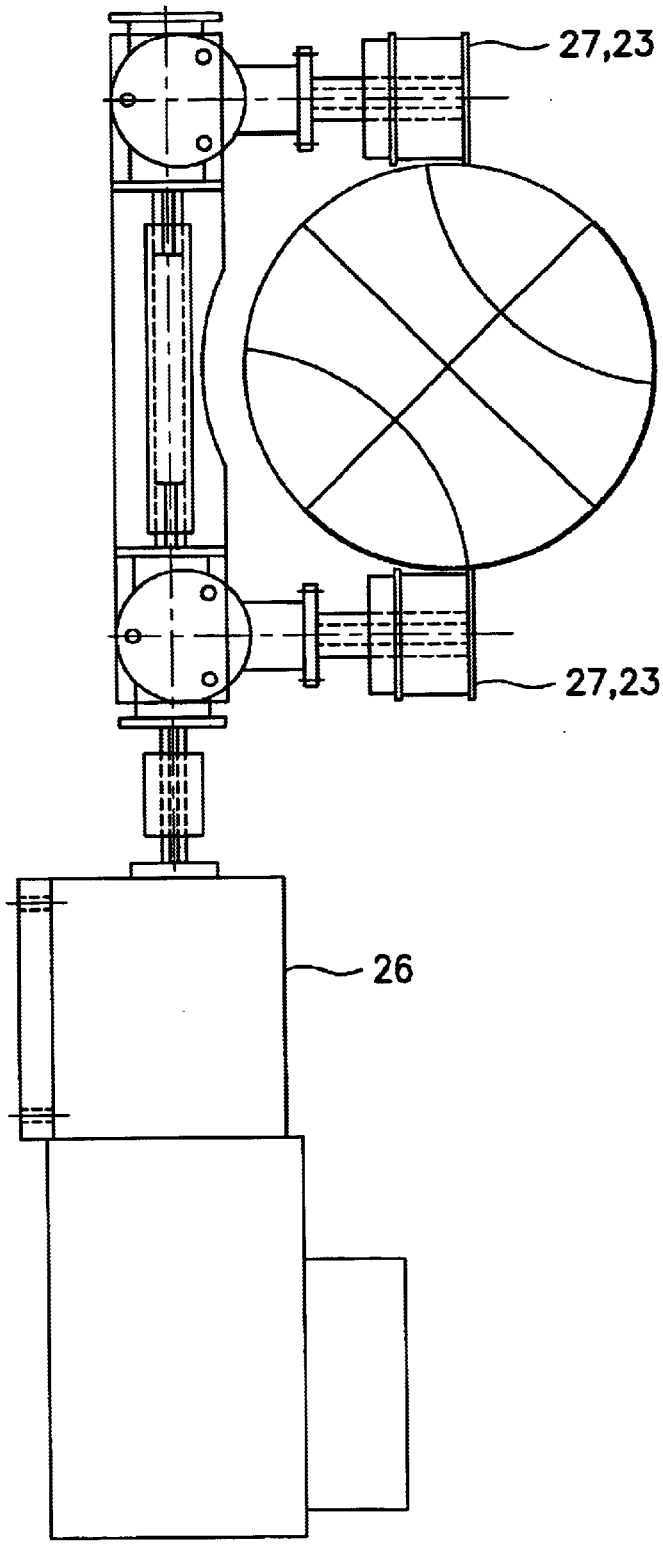
FIG. 5 is a diagram that illustrates the dual belt ball feed system shown in FIG. 4, taken along lines 5—5.
Figure 6:
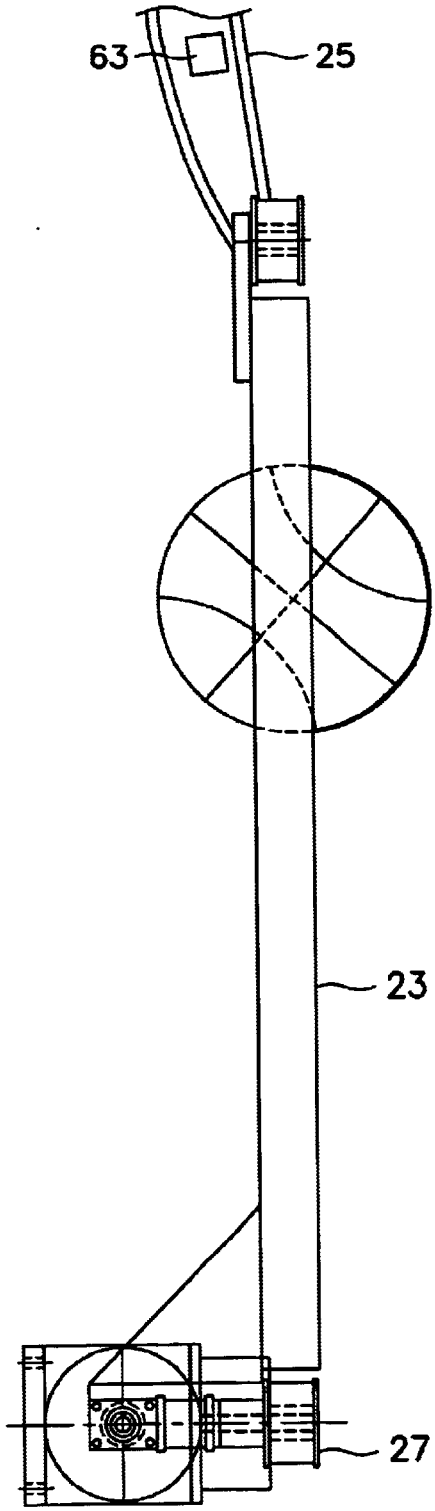
FIG. 6 is a diagram that illustrates the dual belt ball feed system shown in FIG. 4, taken along lines 6—6.

FIG. 3 illustrates additional features of the basketball system 100, in accordance with another embodiment of the present invention. For instance, FIG. 3 also illustrates a ball return system 70 that is located in the base portion 52 of the basketball system 100. Additional details of the ball return system 70, in accordance with one embodiment of the present invention, are also illustrated in FIGS. 4 to 6. Specifically, FIG. 4 is a diagram, in plan view, that illustrates the dual belt ball feed system 23, according to one embodiment of the present invention FIG. 5 is a diagram that illustrates the dual belt ball feed system shown in FIG. 4, taken along lines 5—5. FIG. 6 is a diagram that illustrates the dual belt ball feed system shown in FIG. 4, taken along lines 6—6. The ball return system 70 is configured to convey a ball from a position adjacent to the bottom portion of the pole 12 to a player position, thereby enabling a player to re-use the same balls repeatedly without needing to manually retrieve the balls after each shot.

In the embodiment shown, the ball return system 70 includes a single belt ball return conveyor 71 that extends from a first end 71*a* at a position approximately adjacent to the base portion of the pole 12 to a second end 71*b* towards the player position. The single belt ball return conveyor 71 conveys a ball, after it has been shot by a player and fallen to the base 52, from its first end 71*a* to its second end 71*b*. Thus, as the balls are shot, the single belt ball return conveyor 71 returns them to the front of the basketball system 100. This single belt ball return conveyor 71 is motor driven so that all balls are returned at a predetermined rate of speed.

When a ball arrives at the second end 71*b* of the horizontal conveyor 71, it is directed onto a first end 72*a* of an angled conveyor 72. The angled conveyor 72 conveys the ball to a second end 72*b* of the angled conveyor 72, the second end 72*b* being at a higher vertical position than the first end 72*a*, and onto a ball rack 25. The ball rack 25 is preferably positioned at a height which is easily accessible to a player standing in the player position 105. In order to prevent the ball from rolling back down to the first end 72*a* of the angled conveyor 72, the ball, when being lifted by the angled conveyor 72, is also engaged by a dual belt ball feed system 23. The dual belt ball feed system 23 employs a pair of belts, each of which engages a side of the ball. In a preferred embodiment, the dual belt ball feed system 23 is designed so that a ball will not spin as it is being lifted to the ball rack 25, therefore reducing the likelihood that the ball will get jammed in the machine. This is accomplished by using a single shaft driven motor 26 to power the dual belt ball feed system 23. Pulleys 27, each of which are driven by the single shaft motor 26, revolve at the same rate of speed as each other, and in turn rotate each belt of the dual belt ball feed system 23 at the same rate of speed as each other. This insures that the balls do not spin while being conveyed to the ball rack 25, thereby reducing the likelihood of two balls locking against each other or causing a jam to occur.

The release of the ball onto the ball rack 25 is, in accordance with one embodiment of the present invention, controlled by a ball sensor 63 which is mounted in the ball rack 25. The ball sensor 63 may be coupled to the controller 60. In this embodiment, the ball return system 70 may be controlled, e.g., may be regulated to start, when the ball sensor 63 provides a signal to the controller 60 that indicates that the ball rack 25 requires additional balls, or, e.g., may be regulated to stop, when the ball sensor 63 provide a signal that indicates that the ball rack 25 has a sufficient number of balls. In this manner, the ball return system 70 may be controlled to operate at a pace equal to that of the player. In addition, by controlling the operation of the ball return system 70 using the ball sensor 63 and the controller 60, the potential for ball jamming or any other type of conveyer malfunction may be reduced.

According to a preferred embodiment of the present invention, the ball return system 70 may be adjustable to accept any size basketball, e.g., from the basketball size used in youth leagues to the basketball size used in professional leagues. Specifically, each belt of the dual belt ball feed system 23 may be slidably adjustable, e.g., either closer together or further apart from each other, to enable the dual belt ball feed system 23 to accept basketballs having differing circumferences. In addition, the adjustability of the dual belt ball feed system also enables the handling of various ball materials, such as rubber, composite leather, etc. Basketballs made with different material skins can be used more readily with the system of the present invention because, since balls are lifted and do not spin on the dual belt ball feed system 23, there is a reduced likelihood of the balls jamming.

FIG. 3 also illustrates that the base 52 of the basketball system 100 may be expandable. For instance, in accordance with one embodiment of the present invention, the base 52 includes modules, such as base modules 10 and 11, which may be secured to each other. In this way, the distance that the movable platform 13 may be horizontally adjusted is increased and the distance between the rim 16 and a player position may be increased or decreased as desired. Thus, for example, a single base module 10 may be employed when the basketball system 100 is used in a youth basketball camp, while a second base module 11 (or a third, fourth, etc.) may be secured to the first base module 10 when the basketball system 100 is used by adults. Thus, by providing a modular-type construction, the basketball system 100 allows various configurations, particularly for users with space limitations or to those who do not desire full court shooting capabilities, such as youth organizations or indoor amusement centers. In addition, this modular-type construction allows for simplified relocation in small areas, where modules can be easily detached from each other and moved separately to alternative locations. In addition, the basketball system 100 may be constructed in predetermined sizes, e.g., a small size and a large size. According to this embodiment, the different sized systems may still permit adjustments for different size preferences by having components, e.g., backboards, rims, etc., that are interchangeable.

FIG. 3 also illustrates a ball containment system 80. The ball containment system 80 may be employed to prevent a ball that has been shot by a player from bouncing away from the basketball system 100, and to instead direct the ball to the single belt conveyor 71 for return to the player. In a preferred embodiment, the ball containment system 80 includes netting 7 that is held in position by adjustable poles 8. According to one embodiment of the present invention, the poles 8 are raised or lowered, or otherwise adjusted, by hydraulic or mechanical devices, to facilitate the transport or set-up of the basketball system 100 more easily. As with the base 52, the ball containment system 80 preferably may be expandable or may have a modular-type construction, so that additional poles 8 and netting 7 may be used when additional base portions 52 are used to extend the shooting distance.

According to still another embodiment of the present invention, the basketball system 100 is foldable, retractable or collapsible, so as to allow it to be transported more easily. For example, in the embodiment shown in FIG. 1, the pole 12 is mounted to the movable platform 13 by a hinge 9. Upon rotation of the hinge 9, the pole 12 may be lowered into a horizontal or nearly horizontal position. Likewise, and as previously mentioned, the basketball system 100 may be configured such that the ball containment system 80 is foldable, retractable or collapsible, or simply adjustable and/or removable, permitting the basketball system 100 to be transported more easily. Preferably, no disassembly of the basketball system 100 is required. Advantageously, once the basketball system 100 is folded or otherwise configured to be transported, it has a total size, e.g., height, width, etc., that allows the basketball system 100 to fit through conventional doorways and buildings. In one embodiment, the basketball system 100 is equipped with industrial-strength coasters allowing the basketball system 100 to be rolled during transport.

The basketball system 100 may be constructed of materials that enable it to be used both indoors and outdoors. According to one embodiment, the basketball system 100 may be equipped with a coin box 5 or other device for receiving payment, such as a debit card reader or smart card system or the like, enabling the basketball system 100 to be utilized as an amusement device within the entertainment industry. In addition, the basketball system 100 may be used as a training enhancement system for basketball organizations and sports camps.

The basketball system 100 improves the design of conventional basketball systems in various ways. For instance, the basketball system 100 is compact in size and is easily transportable. In addition, the basketball system 100 provide users with a full scale, reality-based basketball system, unlike most conventional basketball systems that employ smaller-than-regulation basketballs and rims. Furthermore, the basketball system 100 does not rely, as do most conventional basketball games, on a sloped or angled floors as a means for returning the balls to the player, but instead employs a straight, or horizontal floor. In this regard, the basketball system 100 is more similar to a real basketball game, in which the player sees a basket positioned at the same height from the playing surface regardless of the shot distance, as opposed to a conventional basketball system that impedes the player's perception due to the floor sloping upwards towards the rim.

In addition, the basketball system 100, by automatically adjusting the horizontal position of the pole 12 in accordance with a predetermined program, eliminates the need for a player to horizontally reposition the pole 12, either manually or by using the user interface 4, prior to each shot. Furthermore, the basketball system 100, by automatically adjusting the rotational position of the pole 12 in accordance with the predetermined program, eliminates the need for a player to rotationally reposition the pole 12, either manually or by using the user interface 4, prior to each shot. In addition, the player does not have to reposition him or herself between shots. The present invention also provides the feature that a player can practice shots from an identical distance from the rim, at various different angles, while the system, e.g., the controller 60, only needs to adjust the rotation of the pole 12, by virtue of the fact that the central axis 17 of the rim 16 is coaxial with the pole 12.

While there may exist other conventional basketball systems that rotate the pole on which a backboard and rim are mounted, or that enable the horizontal distance of the pole to be changed, these conventional systems do not provide the benefits of the basketball system 100. For instance, conventional systems that employ a rotating pole to change the shooting angle typically employ a straight pole, having a backboard and rim mounted thereto. Still other systems may employ a straight, horizontally-adjustable pole for changing the distance between a player and the rim. However, because the poles employed by these systems are straight, the center of the rims are not coaxial with the pole. Thus, when such a conventional basketball system rotates the pole to change the shooting angle, the distance between the player position and the rim is necessarily changed. In order for the shooting distance to remain unchanged, the conventional basketball system must adjust both the rotational position of the pole and the horizontal distance between the player position and the pole, thereby increasing the complexity of the system and causing a delay in achieving a desired series of shots from an identical distance but from different angles.

Thus, the several aforementioned objects and advantages of the present invention are most effectively attained. Those skilled in the art will appreciate that numerous modifications of the exemplary embodiments described hereinabove may be made without departing from the spirit and scope of the invention. Although various exemplary embodiments of the present invention have been described and disclosed in detail herein, it should be understood that this invention is in no sense limited thereby and that its scope is to be determined by that of the appended claims.

What is claimed is:

1. A basketball system, comprising:

a movable platform;

a pole rotatably mounted to the movable platform, the pole having an axis of rotation;

a backboard mounted to the pole;

a rim mounted to the backboard, wherein the rim has a vertical central axis that is coaxial with the axis of rotation of the pole; and a distance sensor, the distance sensor for determining a distance between the pole and a player position.

2. The system of claim 1, further comprising a scoring sensor, the scoring sensor for determining when a ball passes through the rim.

3. The system of claim 1, further comprising a rotational sensor, the rotational sensor for determining a rotation of the pole.

4. The system of claim 1, further comprising a rotation mechanism for rotating the pole relative to the movable platform.

5. The system of claim 4, wherein the rotation mechanism includes a motor and a gearbox.

6. The system of claim 4, further comprising a controller, the controller configured to control the operation of the rotation mechanism in accordance with at least one of a program stored in the controller and a user preference provided via a user interface.

7. The system of claim 1, wherein the pole has at least one of a curved and an angled region.

8. The system of claim 1, further comprising a base, wherein the movable platform is horizontally adjustably mounted to the base.

9. The system of claim 1, wherein the system is expandable for increasing a distance that the movable platform is horizontally adjustable.

10. The system of claim 1, wherein the system is at least one of foldable, retractable or collapsible for transporting.

11. The system of claim 10, wherein the pole is mounted to the platform by a hinge, whereby the hinge rotates so as to rotate the pole to a substantially horizontally position.

12. A basketball system, comprising:

a movable platform;

a pole rotatably mounted to the movable platform, the pole having an axis of rotation;

a backboard mounted to the pole;

a rim mounted to the backboard, wherein the rim has a vertical central axis that is coaxial with the axis of rotation of the pole;

a rotation mechanism for rotating the pole relative to the movable platform a controller, the controller configured to control the operation of the rotation mechanism in accordance with at least one of a program stored in the controller and a user preference provided via a user interface; and a rotational sensor for determining a rotation of the pole, wherein the controller is configured to control the operation of the rotation mechanism in accordance with a signal from the rotational sensor.

13. A basketball system, comprising:

a movable platform;

a pole rotatably mounted to the movable platform, the pole having an axis of rotation;

a backboard mounted to the pole;

a rim mounted to the backboard, wherein the rim has a vertical central axis that is coaxial with the axis of rotation of the pole; and a horizontal adjustment mechanism for horizontally adjusting the movable platform relative to the base.

14. The system of claim 13, wherein the horizontal adjustment mechanism includes at least one of a motor, a chain and wheels.

15. The system of claim 13, further comprising a controller, the controller configured to control the operation of the horizontal adjustment mechanism in accordance with at least one of a program stored in the controller and a user preference provided via a user interface.

16. The system of claim 13, further comprising a distance sensor for determining a distance between the pole and a player position, wherein the controller is configured to control the operation of the horizontal adjustment mechanism in accordance with a signal from the distance sensor.

* * * * *